US006979283B2

(12) United States Patent
Pan et al.

(10) Patent No.: US 6,979,283 B2
(45) Date of Patent: Dec. 27, 2005

(54) LOCKING DEVICE TO LOCK A COLLAPSIBLE TREADMILL DECK IN A FOLDED POSITION

(76) Inventors: Francis Pan, No. 7, Tatun 15th St., Taichung (TW); Shih-Huang Chu, 5F-9, No. 10, Alley 12, Lane 297-8, Sec. 2, Hsi-Tun Rd., Taichung (TW); Tzu-Peng Chiang, No. 47, Sec. 1, Yongfu Rd., Yonggjing Hsiang, Changhua Hsien (TW)

( * ) Notice: Subject to any disclaimer, the term of this patent is extended or adjusted under 35 U.S.C. 154(b) by 0 days.

(21) Appl. No.: 10/787,976

(22) Filed: Feb. 27, 2004

(65) Prior Publication Data

US 2005/0192162 A1 Sep. 1, 2005

(51) Int. Cl.[7] ..... A63B 22/02
(52) U.S. Cl. ..... 482/54
(58) Field of Search ..... 482/51, 54, 908; 411/348; 248/682, 188.5; 24/653

(56) References Cited

U.S. PATENT DOCUMENTS 3,243,837 A * 4/1966 Smith ..... 16/429
3,596,554 A * 8/1971 Low et al. ..... 411/348
4,635,327 A * 1/1987 Netznik ..... 24/653
4,940,233 A * 7/1990 Bull et al. ..... 482/112
5,513,825 A * 5/1996 Gutgsell ..... 248/188.5
5,527,245 A * 6/1996 Dalebout et al. ..... 482/54
5,672,140 A * 9/1997 Watterson et al. ..... 482/54
5,803,874 A * 9/1998 Wilkinson ..... 482/54
5,860,894 A * 1/1999 Dalebout et al. ..... 482/54
6,082,680 A * 7/2000 Woodward et al. ..... 248/682
6,592,496 B1 * 7/2003 Tsou ..... 482/54
6,857,991 B2 * 2/2005 Yu ..... 482/54

* cited by examiner

*Primary Examiner*—Stephen R. Crow
(74) *Attorney, Agent, or Firm*—Hershkovitz & Associates; Abe Hershkovitz

(57) ABSTRACT

A locking device to lock a collapsible treadmill deck in a folded position includes a telescopic tube and a lock. The telescopic tube includes an outside tube and an inside tube. The outside tube has a though hole. The inside tube is telescopically mounted in the outside tube and has multiple positioning holes corresponding to the through hole. The lock is attached to the outside tube, aligned with the through hole and includes a mounting bracket, an adjusting knob and a detent assembly. The adjusting knob is rotatably and retractably mounted on the mounting bracket. The detent assembly includes a rotating shaft with a locking pin movably mounted in the mounting bracket and connected to the adjusting knob. Therefore, the locking pin will be pulled into one of the positioning holes to engage the inside tube by pushing the adjusting knob toward the mounting bracket.

5 Claims, 5 Drawing Sheets

LOCKING DEVICE TO LOCK A COLLAPSIBLE TREADMILL DECK IN A FOLDED POSITION

BACKGROUND OF THE INVENTION

1. Field of the Invention

The present invention relates to exercise treadmills, and more particularly to a locking device to lock a collapsible treadmill deck in a folded position and the locking device provides an enhanced stability to hold the treadmill deck in position.

2. Description of Related Art

Treadmills are common items of exercise equipment and are popular for people to do indoor exercises, such as running, jogging, walking etc. A. conventional treadmill is bulky and is inconvenient to temporarily store or transport. Therefore, the treadmill today generally uses a collapsible treadmill deck to reduce a size of the whole treadmill when the treadmill is not in use. A conventional collapsible treadmill comprises a base assembly, a collapsible treadmill deck and an upright structure. The upright structure is mounted on the base assembly. The treadmill deck is pivotally mounted to the base assembly. Therefore, the treadmill can be held in either a horizontal position or a vertically folded position.

There are various means can be found to keep the treadmill deck to stay in a given folded position. One of them is to use a locking device with a lock and a telescopic tube to support and lock the treadmill deck while the treadmill deck is in the given folded position. The telescopic tube has a top end and a bottom end and comprises an inside tube and an outside tube. The top end is pivotally mounted to the treadmill deck. The bottom end is pivotally mounted to the base assembly. The inside tube is telescopically mounted in the outside tube. The lock is mounted on the telescopic tube to interlock the inside tube with the outside tube in position so as to retain the treadmill deck in the given folded position.

However, the locking device to lock the telescopic tube must be reliable to avoid the treadmill deck suddenly falling from the folded position, particularly if a person inadvertently bumps into or leans on the treadmill deck. Since the treadmill deck is generally very heavy, the unexpected movement of the falling treadmill deck may cause an injury to any person who is near the treadmill deck.

Therefore, the present invention provides an improved locking device to lock firmly a collapsible treadmill deck in a given folded position to mitigate or obviate the aforementioned problems.

SUMMARY OF THE INVENTION

The main objective of the invention is to provide a locking device to lock a collapsible treadmill deck in a given folded position and the locking device provides an enhanced stability of locking the treadmill deck in position.

A locking device to lock a collapsible treadmill deck in a folded position includes a telescopic tube and a lock. The telescopic tube includes an outside tube and an inside tube. The outside tube has a through hole. The inside tube is telescopically mounted in the outside tube and has one or multiple in-line positioning holes corresponding to the through hole. The lock is attached to the outside tube, aligned with the through hole and includes a mounting bracket, an adjusting knob and a detent assembly. The mounting bracket has a passage aligned with the through hole. The adjusting knob is rotatably and retractably mounted on the mounting bracket. The detent assembly is movably mounted in the passage and includes a rotating shaft and a locking pin. The rotating shaft has an inside end and an outside end. The outside end is connected to the adjusting knob. The locking pin is attached to the rotating shaft at the inside end. Therefore, the locking pin will be pulled into one of the positioning holes to engage the inside tube as the adjusting knob is pushed toward the mounting bracket.

Other objectives, advantages and novel features of the invention will become more apparent from the following detailed description when taken in conjunction with the accompanying drawings.

DETAILED DESCRIPTION OF PREFERRED EMBODIMENT

Figure 1:
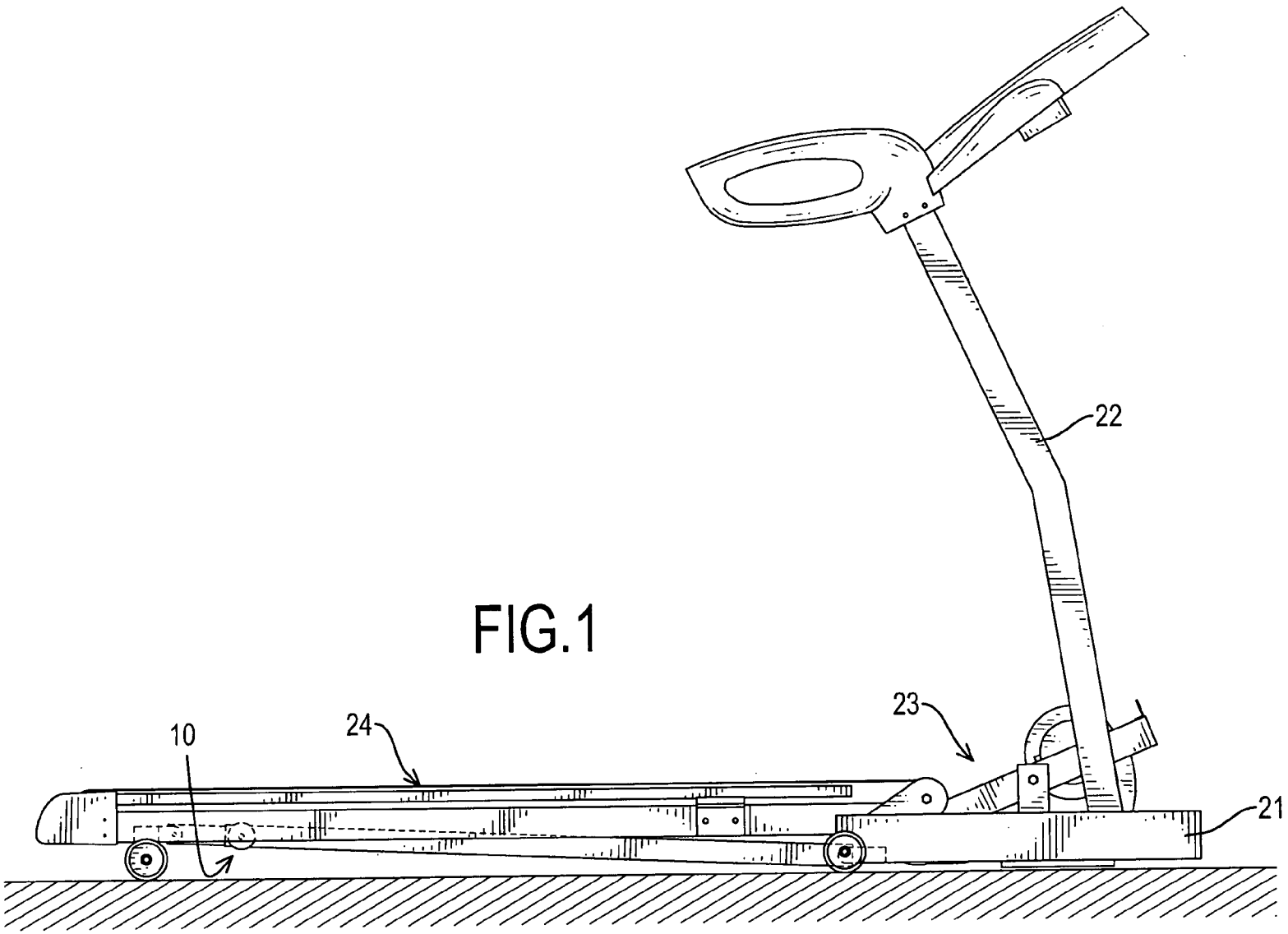
FIG. 1 is a side plan view of a treadmill with a collapsible treadmill deck that uses a locking device in accordance with the present invention when the treadmill deck is in a horizontal position.
Figure 2:
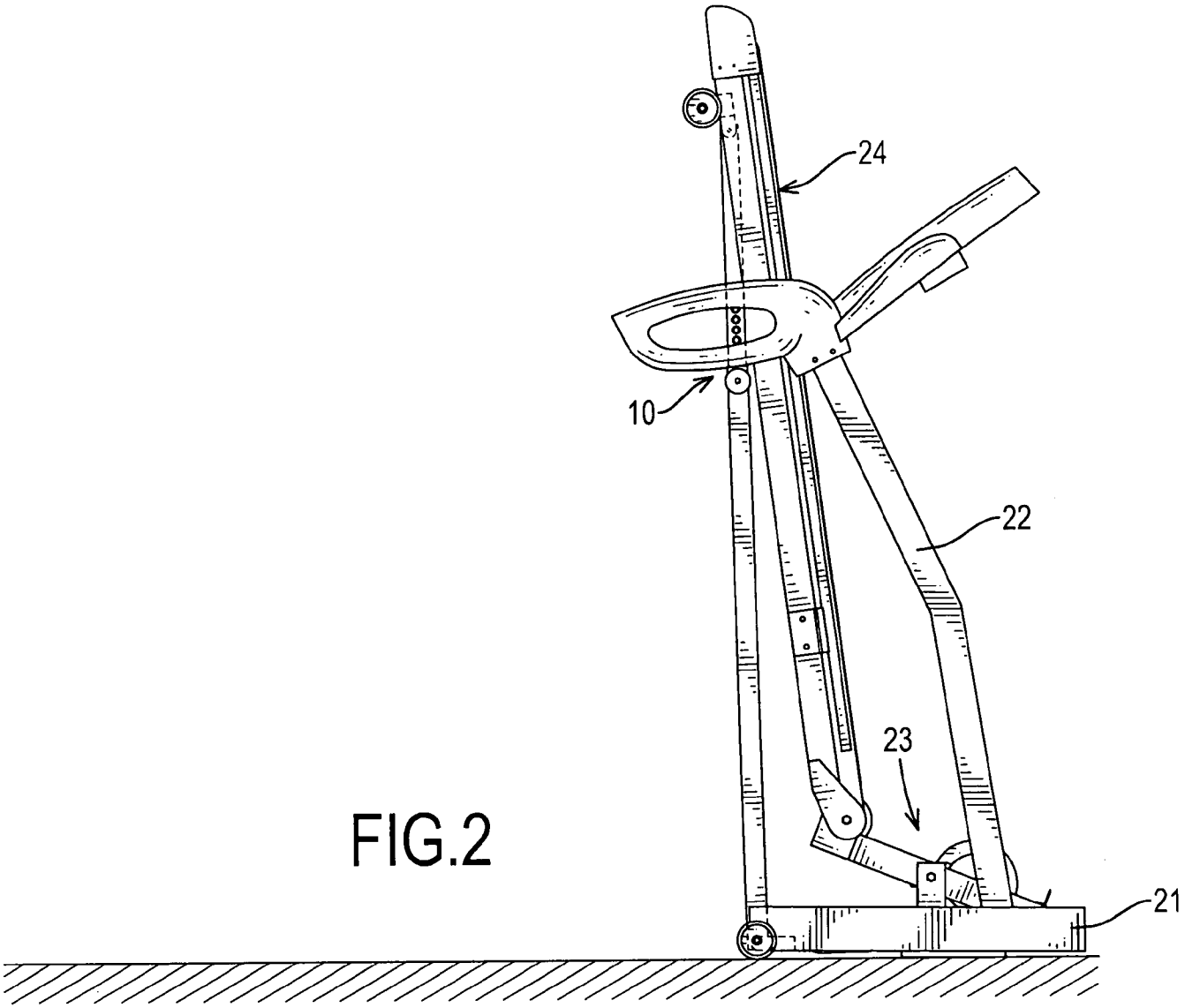
FIG. 2 is a side plan view of the treadmill in FIG. 1 when the treadmill deck is folded up in a vertically folded position.

With reference to FIGS. 1 and 2, a preferred embodiment of a treadmill with a locking device in accordance with the present invention comprises a base assembly (21), an upright structure (22), a collapsible treadmill deck (24) and a locking device (10) in accordance with the present invention. The base assembly (21) has an inclination mechanism (23) to change an inclination of the treadmill deck (24). The upright structure (22) is mounted to the base assembly (21). The treadmill deck (24) has a bottom (not numbered), a front end (not numbered) and a rear end (not numbered). The front end is pivotally mounted to the inclination mechanism (23) so that the treadmill deck (24) can be folded from a horizontal position as shown in FIG. 1 to a vertically folded position as shown in FIG. 2.

Figure 3:
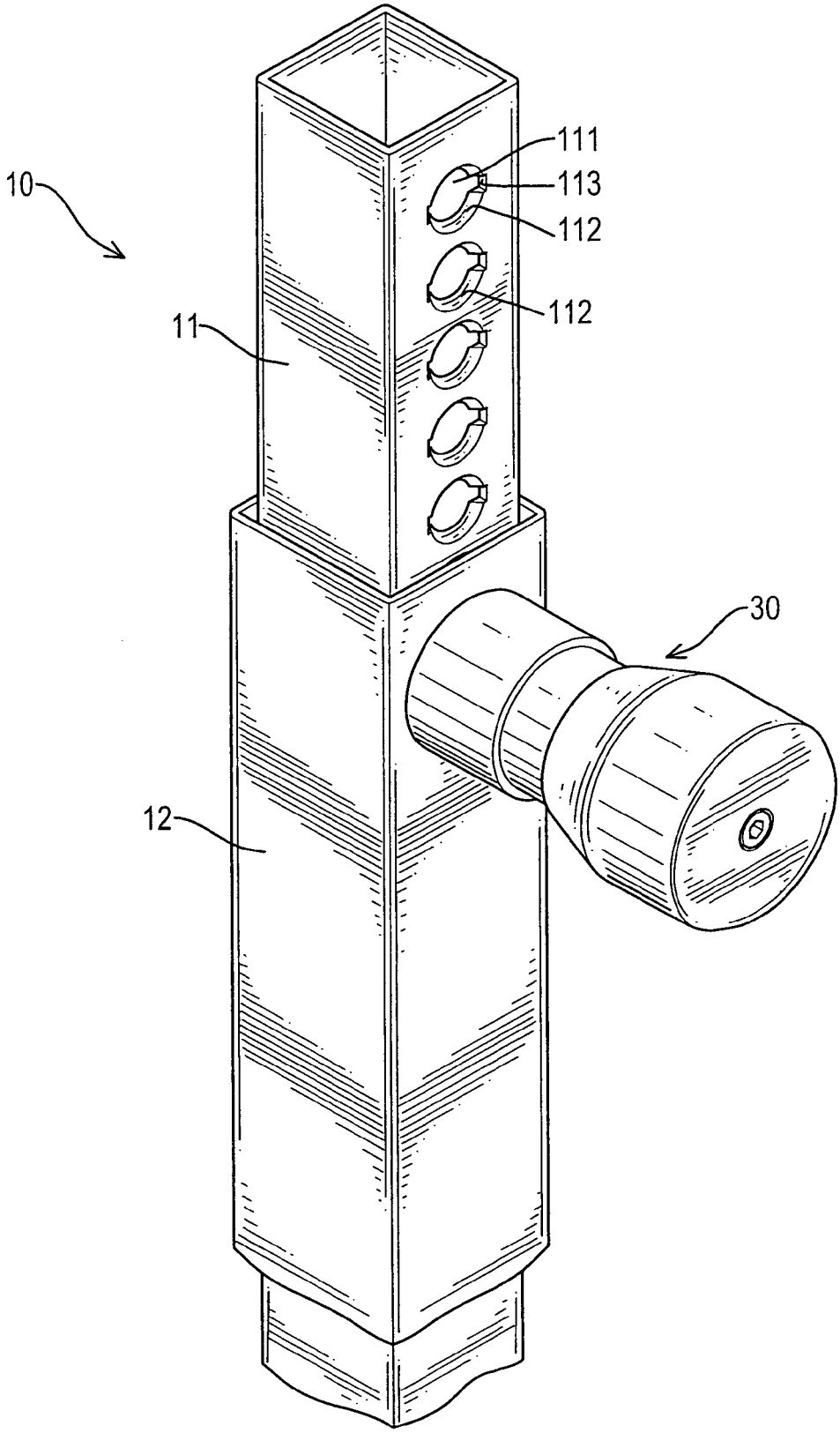
FIG. 3 is a perspective view of the locking device in accordance with the present invention.
Figure 4:
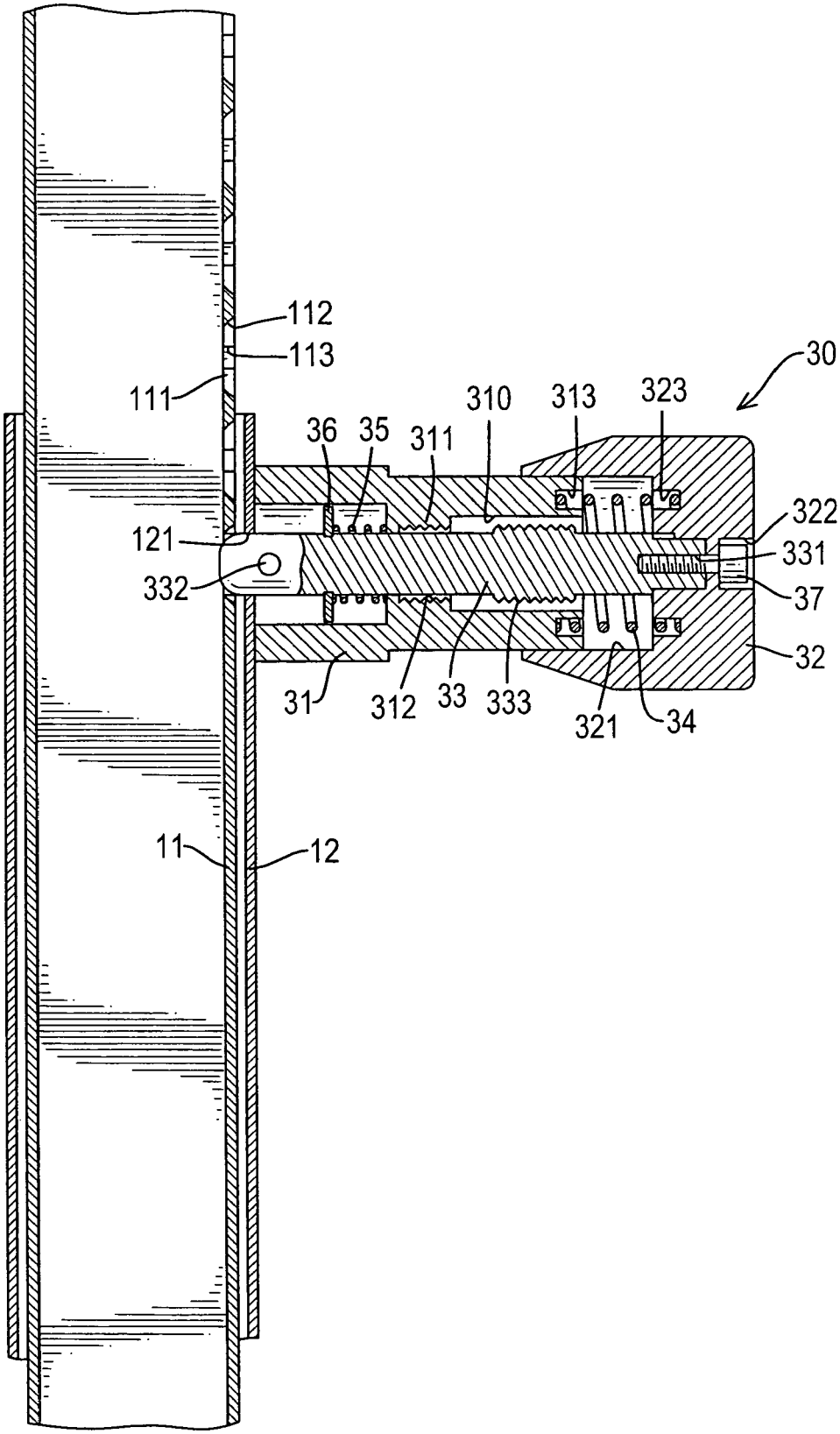
FIG. 4 is a cross sectional plan view of the locking device when a lock of the locking device is unlocked.
Figure 5:
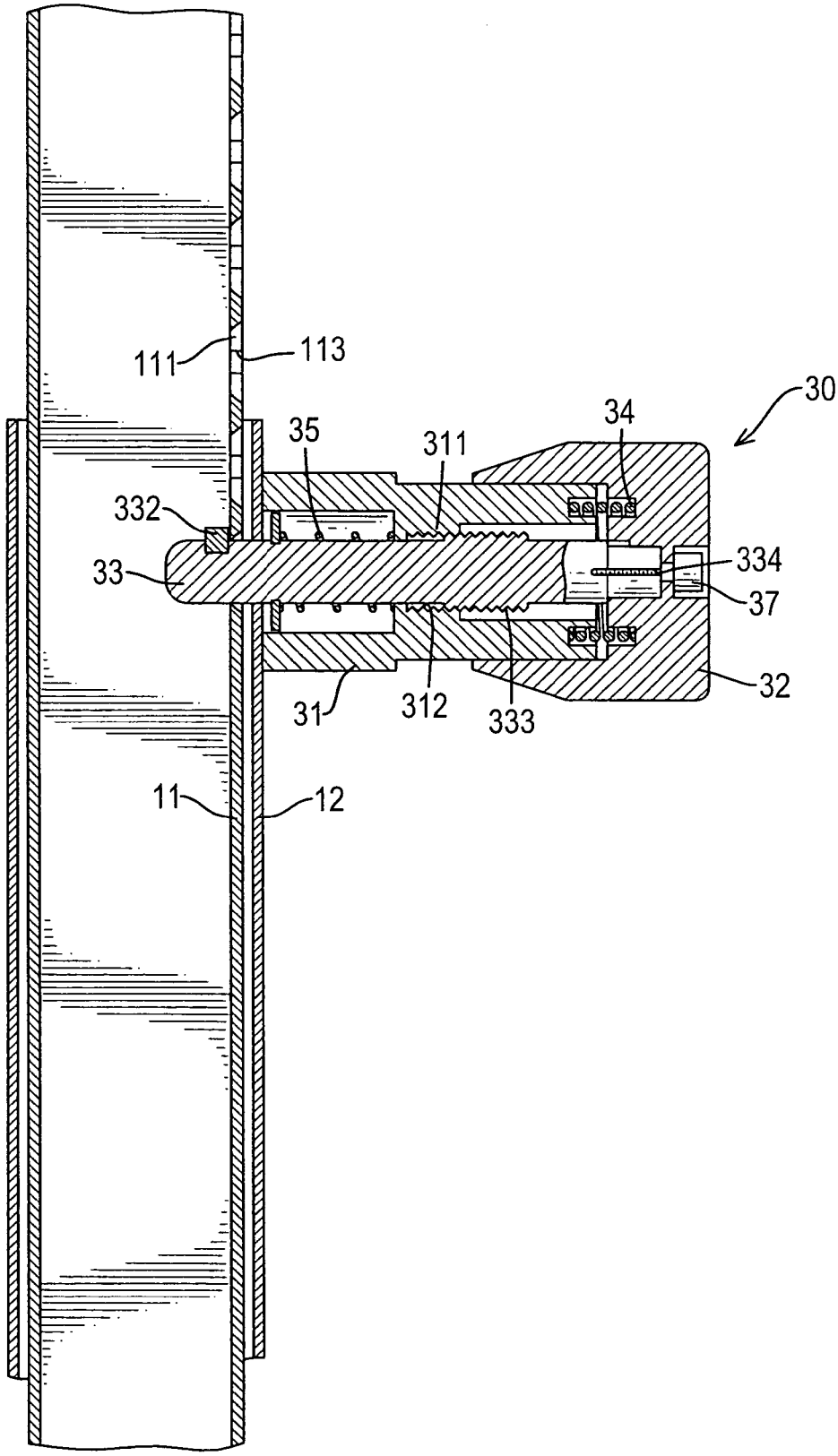
FIG. 5 is an operational cross sectional plan view of the locking device in FIG. 4 when the lock is locked.

With further reference to FIGS. 3 to 5, the locking device (10) is used to hold the treadmill deck (24) in the folded position and comprises a telescopic tube (not numbered) and a lock (30). The telescopic tube has a top end (not numbered) and a bottom end (not numbered) and comprises an inside tube (11) and an outside tube (12). The top end is pivotally mounted to the bottom of the treadmill deck (24) at the rear end. The bottom end is pivotally mounted to the base assembly (21). The inside tube (11) has an inside end (not numbered) and an outside end (not numbered). The outside end is pivotally mounted to the to the bottom of the treadmill deck (24) at the rear end. The inside end is telescopically mounted in the outside tube (12). The outside tube (12) has an open end (not numbered) and a pivot end (not numbered). The open end slidably holds the inside end of the inner tube (11). The pivot end is pivotally mounted to the base assembly (21).

The inside and the outside tubes (11, 12) are square or rectangular in cross-section. The inside tube (11) has an exterior periphery (not numbered), a side (not numbered) and one or more than one in-line positioning holes (111).

Each of the positioning holes (111) can be used to position the treadmill deck (24) at an individual degree of angle by interlocking the inside tube (11) with the outside tube (12) in relation to one of the positioning holes (111). The positioning holes (111) are defined through the exterior periphery at the side of the inside tube (11) and each has an annular edge (not numbered), an inclined surface (112) and two opposite slots (113). The inclined surface (112) is defined along the annular edge. The slots (113) are defined diametrically at the annular edge.

The outside tube (12) has a through hole (121) and an exterior periphery (not numbered). The through hole (121) is aligned with the positioning holes (111). The lock (30) is attached to the exterior periphery of the outside tube (12) above the through hole (121) and comprises a mounting bracket (31), an adjusting knob (32) and a detent assembly. The mounting bracket (31) has a stationary end (not numbered), a free end (not numbered) and a passage (310). The stationary end is fastened on the exterior periphery of the outside tube (12). The passage (310), defined through the free end to the stationary end, is aligned with the through hole (121) and has an interior periphery (not numbered). The detent assembly is movably mounted in the passage (310) and comprises a rotating shaft (33) and a locking pin (332). The rotating shaft (33) has an exterior surface (not numbered), an inside end (not numbered) and an outside end (not numbered). The inside end extends through the through hole (121) and is slightly held in one of the positioning holes (111). The locking pin (332) is attached to the exterior surface at the inside end and is selectively extendable through one of the slots (113) to engage the inner tube (11). The adjusting knob (32) is rotatably and retractably mounted at the free end of the mounting bracket (31) and connects to the outside end of the rotating shaft (33). Thus, pushing the adjusting knob (32) will simultaneously move the locking pin (332) to extend through one of the slots (113) and the inside end of the rotating shaft (33) inward to the inner tube (11). Then, rotating the adjusting knob (32) will simultaneously rotate the locking pin (322) to engage with the inside tube (11) to interlock the inside tube (11) in relation to the outside tube (12). Therefore, the telescopic tube cannot be extended or retracted further and supports the folded treadmill deck (24) in place. The treadmill deck (24) is held in the given folded position by the locked telescopic tube.

The mounting bracket (31) can further have an annular shoulder (311), an interior thread (312) and a first annular slot (313). The annular shoulder (311) is formed from the interior periphery of the passage (310). The interior thread (312) is formed on the shoulder (311). The first annular slot (313) is defined in the free end.

The adjusting knob (32) has an overlapped end (not numbered), an outside end (not numbered), a sliding hole (321), a countersunk hole (322), a blind hole (not numbered) and a second annular slot (323). The sliding hole (321) is defined in the overlapped end to slidably hold the free end of the mounting bracket (31) and has a periphery (not numbered). The blind hole is defined concentrically in the periphery defining the sliding hole (321). The countersunk hole (322) is defined concentrically through the outside end and communicates with the blind hole. The second annular slot (323) is defined in the overlapped end and corresponds to the first annular slot (313) in the mounting bracket (31).

The rotating shaft (33) further has a longitudinal threaded hole (331), an exterior thread (333) and multiple spacer slots (334). The longitudinal threaded hole (331) is defined in the outside end. The exterior thread (333) is formed on the exterior surface and is used to screw with the interior thread (312). The spacer slots (334) are defined at the outside end around the longitudinal threaded hole (331). The outside end of the rotating shaft (33) fits in and is held in the blind hole.

The detent assembly further comprises a primary spring (34), a secondary spring (35), a spring stop (36) and a fastener (37). The primary spring (34) is mounted on the rotating shaft (33) between the free end of the mounting bracket (31) and the adjusting knob (32) and has two opposite ends (not numbered). The ends of the primary spring (34) are respectively held in the first and the second annular slots (313, 323). The spring stop (36), such as a C-clamp is attached to the exterior surface of the rotating shaft (33) between the inside end and the shoulder (311). The secondary spring (35) is mounted on the rotating shaft (33) between the spring stop (36) and the shoulder (311) and has two opposite ends (not numbered). The ends of the secondary spring (35) respectively abut the spring stop (36) and the shoulder (311).

The fastener (37), such as a bolt is held in the countersunk hole (322) and screws into the longitudinal threaded hole (331) in the rotating shaft (33). As the fastener (37) screws into the longitudinal threaded hole (331), the spacer slots (334) permit the outside end of the rotating shaft (33) to engage the blind hole to interlock the rotating shaft (33) with the adjusting knob (32). Thus, the adjusting knob (32) can push the rotating shaft (33) inward to the mounting bracket (31) and rotate the rotating shaft (33).

With reference to FIGS. 2, 4 and 5, the primary and the secondary springs (34, 35) maintain the rotating shaft (33) in a balanced state. When the treadmill deck (24) is pivoted upward and folded up from the horizontal position to the folded position, the pivotal movement of the treadmill deck (24) will pull the top end of the telescopic tube, which simultaneously pull the outside end of the inside tube (11) so that the inside tube (11) is drew from the outside tube (12) to lengthen the telescopic tube. The inside end of the rotating shaft (33) will slide out of the current one of the positioning holes (111) and along the inclined surface (112) to slide on the exterior periphery of the inside tube (11), which compresses the secondary spring (35) to create a restitution force. The restitution force will force the inside end of the rotating shaft (33) to slide into the next one of the positioning holes (111), which will cause a clicking sound to notify the user that the positioning has occurred. The inside end of the rotating shaft (33) will repeatedly escape from the current hole (111) and fall into the next one of the positioning holes (111) until the treadmill deck (24) has been folded up to reach a required folded position.

At this moment, pushing the adjusting knob (32) will compress the primary spring (34), to move the inside end of the rotating shaft (33) inward to the inside tube (11) through the current one of the positioning holes (111) and make the locking pin (332) extend through one of the slots (113). Then, rotating the adjusting knob (32) will rotate the locking pin (332) to engage the inside tube (11) and screw the exterior thread (333) with the interior thread (312). Since the rotating shaft (33) is screwed with the shoulder (311), the lock will provide a reliable and enhanced stability of the locking effect to avoid the treadmill deck inadvertently falling from the given folded position. In addition, the primary and the secondary springs (34, 3 5) provide the balance state for the rotating shaft (33) so that the inside end of the rotating shaft (33) is slightly held in one of the positioning holes (111). The inside end of the rotating shaft (33) is easy to slide out of the current one of the positioning holes (111) and automatically extend into the next one of the positioning holes (111) to cause simultaneously the clicking sound during a period of folding the treadmill deck (24). The clicking sound can indicate to the user how far the inside tube (11) has been pulled out. Thus the locking device is convenient to use.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the scope of the appended claims.

What is claimed is:

1. A locking device for a treadmill having a collapsible treadmill deck and a base assembly to lock the collapsible treadmill deck in a folded position relative to the base assembly, and the locking device comprising:

a telescopic tube comprising an outside tube having an exterior periphery, a bottom end pivotally connected to the base assembly and a through hole defined through the exterior periphery; and an inside tube telescopically mounted in the outside tube and having an exterior periphery, a top end pivotally connected to the collapsible treadmill deck and at least one positioning hole defined through the exterior periphery of the inside tube, and each of the at least one positioning holes corresponding to the through hole, wherein each of the at least one positioning hole has an annular edge, an inclined surface defined along the annular edge and at least one slot defined at the annular edge to allow the locking pin to selectively extend into one of the at least one positioning hole; and a lock attached to the exterior periphery of the outside tube, aligned with the through hole and comprising a mounting bracket fastened on the exterior periphery of the outside tube and having a stationary end, a free end and a passage defined through the free end to the stationary end, aligned with the through hole and having an interior periphery;

an adjusting knob rotatably and retractably mounted at the free end of the mounting bracket; and a detent assembly movably mounted in the passage and comprising a rotating shaft and a locking pin, the rotating shaft having an exterior surface, an inside end and an outside end, and the locking pin attached to the exterior surface of the rotating shaft at the inside end;

wherein the locking pin is selectively extendable into one of the at least one positioning hole to engage the inside tube as the adjusting knob is pushed and rotated.

2. The locking device as claimed in claim 1, wherein the mounting bracket further has an annular shoulder formed in the interior periphery of the passage and an interior thread formed on the shoulder, and the rotating shaft further has an exterior thread formed on the exterior surface to screw with the interior thread.

3. The locking device as claimed in claim 2, wherein the detent assembly further comprises a primary spring mounted on the rotating shaft and between the free end of the mounting bracket and the adjusting knob and having two ends respectively abutting the free end of the mounting bracket and the adjusting knob;

a spring stop attached to the exterior surface of the rotating shaft between the inside end of the rotating shaft and the shoulder; and a secondary spring mounted on the rotating shaft and between the spring stop and the shoulder and having two ends respectively abutting the spring stop and the shoulder.

4. The locking device as claimed in claim 3, wherein the mounting bracket further has a first annular slot defined in the free end;

the adjusting knob has an overlapped end, an outside end, a sliding hole with a periphery defined in the overlapped end to slidably hold the free end of the mounting bracket, a blind hole defined concentrically in the periphery defining the sliding hole, a countersunk hole defined concentrically through the outside end and communicated with the blind hole and a second annular slot defined in the overlapped end corresponding to the first annular slot in the mounting bracket;

the rotating shaft further has a longitudinal threaded hole defined in the outside end and multiple spacer slots defined at the outside end around the longitudinal threaded hole, and the outside end of the rotating shaft fitted in and held in the blind hole; and the detent assembly further comprises a fastener held in the countersunk hole and screwed into the longitudinal threaded hole in the rotating shaft to make the inside end of the rotating shaft to engage the blind hole;

wherein the ends of the primary spring are respectively held in the first and the second annular slots.

5. The locking device as claimed in claim 4, wherein the spring stop is a C-clamp, and the fastener is a bolt.

* * * * *